United States Patent [19]

Bowling

[11] 4,241,289

[45] Dec. 23, 1980

[54] HEAT SENSING APPARATUS FOR AN ELECTRIC RANGE AUTOMATIC SURFACE UNIT CONTROL

[75] Inventor: Teamus Bowling, Fern Creek, Ky.

[73] Assignee: General Electric Company, Louisville, Ky.

[21] Appl. No.: 16,996

[22] Filed: Mar. 2, 1979

[51] Int. Cl.[3] ..... H01H 37/04; H05B 3/68

[52] U.S. Cl. ..... 219/450; 73/362.8; 136/221; 136/230; 338/22 R; 338/28

[58] Field of Search ..... 219/450; 338/22 R, 22 A, 338/25; 73/362.8; 136/221, 230

[56] References Cited

U.S. PATENT DOCUMENTS

| | | | |
|---|---|---|---|
| 2,288,510 | 6/1942 | Brannon . | |
| 2,764,663 | 9/1956 | Molyneaux | 219/450 |
| 2,764,665 | 9/1956 | Walkoe | 219/450 |
| 2,806,122 | 9/1957 | Thunander | 219/450 |
| 2,934,957 | 5/1960 | Reinhart et al. | 73/362.8 |
| 3,153,139 | 10/1964 | Sivacek | 219/450 |
| 3,246,122 | 4/1966 | Wetzel | 219/450 |
| 3,266,002 | 8/1966 | O'Hanlon | 338/25 |
| 3,293,082 | 12/1966 | Brouwer et al. | 136/230 |
| 3,337,309 | 8/1967 | Lewis et al. | 136/230 |
| 3,351,498 | 11/1967 | Shinn et al. | 136/230 |
| 3,714,539 | 1/1973 | Hampl, Jr. | 136/221 |

FOREIGN PATENT DOCUMENTS

| | | | |
|---|---|---|---|
| 243856 | 1/1963 | Australia | 236/221 |

*Primary Examiner*—Gerald P. Tolin
*Assistant Examiner*—Bernard Roskoski
*Attorney, Agent, or Firm*—Bernard J. Lacomis; Radford M. Reams

[57] ABSTRACT

An improved heat sensing apparatus for an electric range automatic surface unit control in which the heat sensor housing is supported within the surface unit by an upwardly biased pivot arm. The upper portion of the sensing apparatus comprises a first utensil contacting layer of a low thermal mass, heat conductive material, a second layer of electrically insulative heat conductive material secured to the underside of the first contact layer, and a third layer of electrically conductive, heat conductive material secured to the underside of the second layer. A thermistor or thermocouple heat sensor is attached to the third layer to provide an electrical signal representative of the utensil temperature to the surface unit temperature controls.

9 Claims, 7 Drawing Figures

HEAT SENSING APPARATUS FOR AN ELECTRIC RANGE AUTOMATIC SURFACE UNIT CONTROL

BACKGROUND OF THE INVENTION

This invention pertains to an improved heat sensing apparatus for use with an automatic surface unit control for an electric range. In particular, it relates to heat sensing apparatus that electrically isolates the heat responsive sensor from the cooking utensil contact button while at the same time offering excellent thermal coupling with the cooking utensil. Such apparatus provides fast response times that make the apparatus of the invention particularly useful in combination with electronic range temperature controls.

The use of automatic temperature controls for electric range surface cooking units is old and well known. Typical examples are illustrated in U.S. Pat. Nos. 2,764,665 and 2,806,122. Generally a utensil temperature sensing device is mounted in the center of the cooking unit to come in physical contact with the bottom of the cooking utensil. Variations in the temperature of the utensil are sensed by a thermistor or a thermocouple arrangement and the resulting signal is used by the automatic temperature control circuitry in conventional manner to maintain a desired cooking temperature as set by the cook. Obviously, the ability of the sensor to accurately sense and follow the temperature variations in the cooking utensil is critical to the success with which the desired cooking temperature can be maintained.

The actual sensor, i.e. the thermistor or thermocouple, is usually mounted within a capsule or housing which is then supported by appropriate means in the center of the surface cooking unit. The interposition of a cover or cap on the housing between the utensil and the sensing device introduces time delays in the feedback loop that can result in significant, undesirable temperature variations occuring within the cooking utensil. Also, the placement of the sensor unit in the middle of the surface unit can result in the accuracy of the unit being adversely affected, both by the radiated heat from the heater coils and by heat transmitted through the support means and housing. In the past, these problems have been resolved by use of thin metal housings and appropriate shielding so that the inaccuracies were minimized to a level that worked satisfactorily with range surface unit controls then in existence.

However, it is now considered desirable to provide heat sensing apparatus with greater sensitivity to utensil temperature and faster response times particularly as electronic controls and improved fast response heating coils become more widely used.

It is, therefore, an object of the present invention to provide an improved heat sensing apparatus for an electric range automatic surface unit temperature control.

It is a further object of the invention to provide such heat sensor with fast response times suitable for use with electronic surface unit controls.

It is a still further object of the invention to provide heat sensing apparatus that is improved in sensitivity and response time over known devices and which is both simple and inexpensive in construction.

SUMMARY OF THE INVENTION

Therefore, in accordance with the invention, there is provided heat sensing apparatus for an automatic surface unit control of an electric range comprising a housing having an upper end portion adapted for contact with the bottom of a cooking utensil when placed on the surface unit and a housing support means for holding the housing within the surface unit and for biasing it upwardly to assure contact of the upper end portion with the utensil bottom. The upper end portion of the housing comprises a first utensil contact layer of a low thermal mass, heat conductive material, a second layer of electrically insulative, heat conductive material secured to the underside of the first contact layer, and a third layer of electrically conductive, heat conductive material secured to the underside of the second insulative layer. Finally, the heat sensing apparatus of the invention includes heat responsive means attached to the third layer for sensing utensil heat as transmitted through the housing upper end portion and for providing an electrical signal representative thereof to said automatic surface unit control.

DETAILED DESCRIPTION OF THE INVENTION

Figure 1:
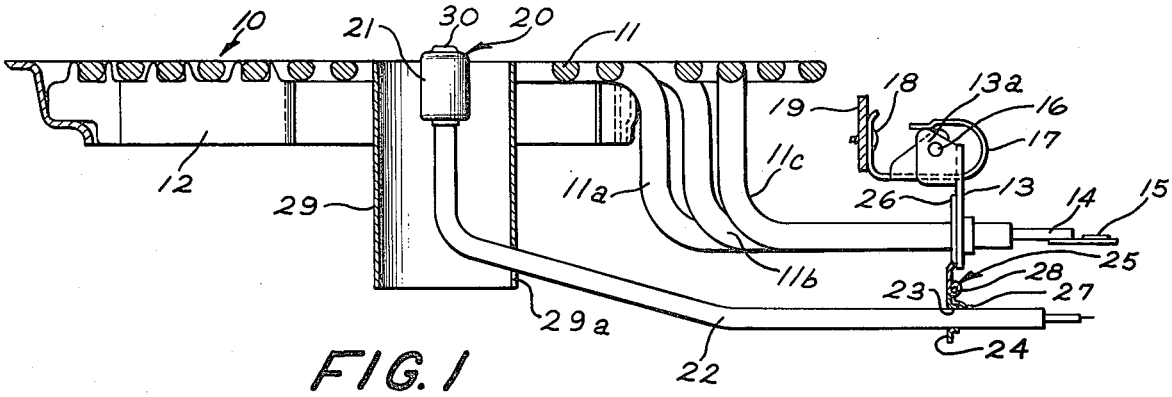
FIG. 1 is a side view in section of a surface cooking unit illustrating a mounting arrangement useful in connection with the heat sensing apparatus of the present invention.

Referring now to FIG. 1 in greater detail, there is shown an exemplary range surface heating unit 10 illustrating a preferred arrangement for mounting of the heat sensing apparatus in the surface unit. The surface unit includes heater coils 11 wound in conventional spiral manner and supported on spider arms 12. As is well known, separate heater coils 11*a*, 11*b*, and 11*c* of differing diameters may be interleaved and independently activated to provide an active unit size that matches the size of a cooking utensil placed on the cooking unit. The ends of the heater coils are brought out through a retaining bracket 13 and the inner conductors 14 of the heater coils are connected to male electrical terminal prongs 15 which are adapted to plug into a conventional female terminal block (not shown).

Retaining bracket 13 has two side flanges 13*a* bent around perpendicular to the main body of bracket 13. Bracket 13 is supported on a spring bracket 17 by means of a pivot pin 16 extending through flanges 13*a* and corresponding flanges similarly formed on spring bracket 17. Spring bracket 17 is, in turn, attached to flange 19 of the range body by means of a screw 18. The upper sloped edges of flanges 13*a* form a cam surface on which the upper arm of spring bracket 17 bears so that the cooking unit 10 can be pivoted upwards and held in a raised position for cleaning underneath the cooking unit.

Figure 1A:
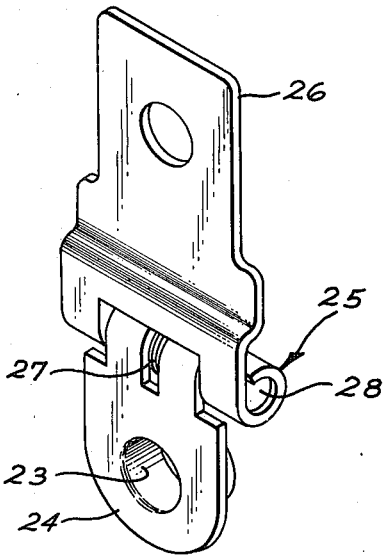
FIG. 1*a* is a perspective view of the hinge and spring structure used in the mounting arrangement of FIG. 1.

Referring now jointly to FIGS. 1 and 1*a*, the heat sensing apparatus 20 of the present invention includes a housing 21 mounted on one end of an elongated, generally L-shaped tubular arm 22. The other end of arm 22 extends through hole 23 of the lower segment 24 of hinged bracket 25 and is fastened thereto by any suitable manner, the upper segment 26 of bracket 25 being welded onto bracket 13. When assembled, bracket 25 includes a bias spring 27 having a circular portion through which hinge pin 28 extends to hold the spring in place. Spring 27 causes the electrical terminal end of arm 22 to pivot downwardly about hinge pin 28 thereby biasing the heat sensing housing 21 upwardly through the central opening of cook unit 10.

A cylinder 29 of low thermal mass metal forms the central core to which the radial arms of spider 12 are attached and also serves to shield sensor housing 21 from radiated heat from the heater coils 11. Arm 22 extends through a slot 29*a* of the shield and bears against the upper end of the slot to restrain the upward movement of housing 21 thereby holding the housing 21 in the proper position slightly above the cooking unit 10 so as to cause the uppermost surface of housing 21 to resiliently contact the bottom of a cooking utensil when it is placed on the cooking unit 10.

Figure 2:
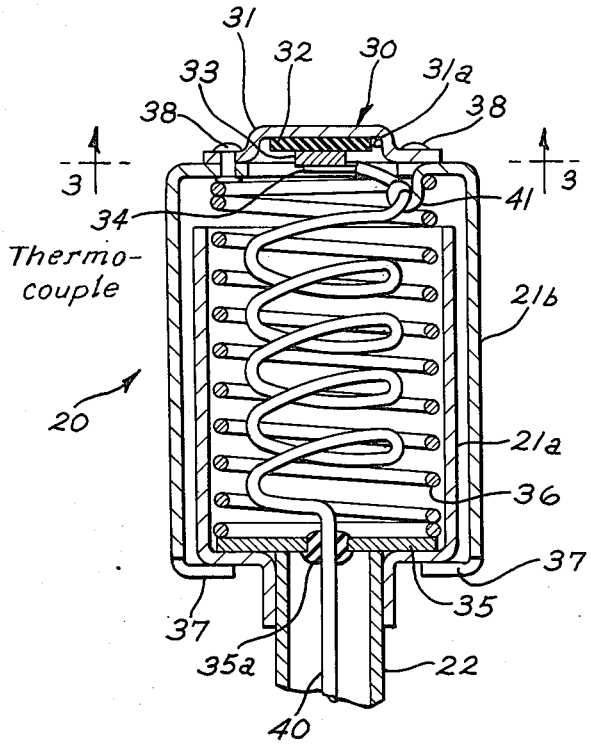
FIG. 2 is a side sectional view of one form of heat sensing apparatus constructed in accordance with the present invention.

Referring now to FIG. 2, there will be described a specific embodiment of the heat sensing arrangement constructed in accordance with one form of the invention for use in the FIG. 1 surface cooking unit. Specifically, in the heat sensing apparatus 20, housing 21 comprises inner and outer tubular housing elements 21*a* and 21*b*, preferably made from relatively thin stainless steel metal to minimize the adverse effect of heat absorption and conduction on the performance of the heat sensor. The bottom of inner housing element 21*a* is formed and attached by swaging or any other suitable manner onto the end of tubular arm 22. Outer tubular housing element 21*b* is positioned over the inner element 21*a* in loose telescoping manner, the diameter of the outer element 21*b* being larger than that of inner element 21*a* by an amount sufficient to allow universal tilting or wobbling movement of the outer element 21*b*.

Within inner element 21*a*, there is provided a compression spring 36 bearing at its lower end on a base disc 35, and at its upper end against the inward projecting flanges of outer housing element 21*b*. Tabs 37, extending from the bottom of element 21*b*, are bent laterally inward underneath the inner housing element 21*a* to hold housing element 21*b* in place against the upward bias provided by compression spring 36. A pair of thermocouple lead wires 40 are brought up through tubular arm 22, through a central hole in base disc 35 and are wound in a loose helical manner inside of compression spring 36. The upper end of the helical portion of lead wires 40 is held loosely in place by means of a tabular loop 41 while the lower end of the helical portion is fixed in place at disc 35 by means of a heat resistant epoxy retainer 35*a*.

Figure 3:
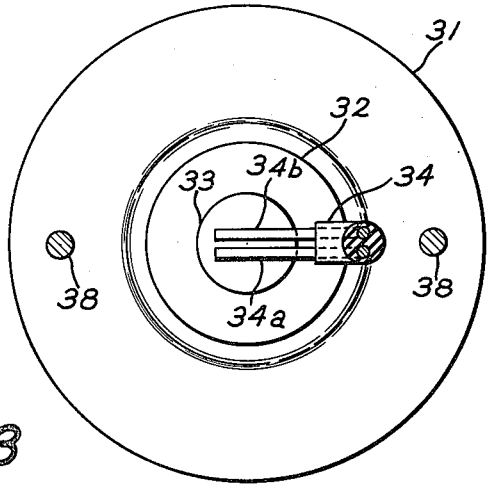
FIG. 3 is a bottom view of the heat sensing end cap employed in the FIG. 2 embodiment of the invention.

In accordance with an important aspect of the invention, and with reference to FIGS. 2 and 3, heat sensing apparatus 20 further includes an upper end portion of housing 21 illustrated in FIG. 2 as being a separate end cap assembly 30 secured to the upper end of outer housing element 21*b* by suitable means, such as rivets 38. It will be appreciated, however, from the description which follows, that assembly 30 may also comprise an assemblage of which the uppermost element or layer is integral with outer housing element 21*b*. End cap assembly 30 of FIG. 2 includes a first utensil contact layer or button 31 formed with an upward recess 31*a* providing for clearance of the rivet heads to permit the top surface of contact button 31 to come into direct contact with the cooking utensil. Button 31 is preferably of a low thermal mass, heat conductive material, one example of which might be a copper-nickel alloy while a preferred example would be a metal composition, by weight, of approximately 29% nickel, 17% cobalt, 0.2% manganese and the balance of iron. Such metal compositions are sold under the trademarks RODAR, by the William B. Driver Co. of Newark, N.J., and KOVAR, by Westinghouse Corp. of Pittsburgh, Pa.

End cap 30 further includes a second layer or pad 32 of electrically insulative, heat conductive material secured as by brazing to the underside of contact button 31. The material of pad 32 may advantageously be comprised of aluminum oxide, however, the preferred choice from a performance standpoint is considered to be beryllium oxide which is available from National Beryllin Corp. of Haskell, N.J. The assembly of end cap 30 further includes a third layer or disc 33 of an electrically conductive, heat conductive material secured as by brazing to the underside of pad 32. The material of disc 33 is preferably the same as that used in contact button 31. One important aspect of the material selection outlined above is that the thermal coefficient of expansion of the three layers is approximately the same with contributes to the long term reliability of heat sensing apparatus in accordance with the invention. In an actually constructed embodiment of end cap 30, the thickness of contact button 31 was set nominally at 0.020 inch while the thickness of pad 32 and disc 33 was each set nominally at 0.020 inch.

Further in accordance with the present invention, the heat sensing apparatus includes heat responsive means attached to the underside of disc 33 for sensing utensil heat as transmitted by conduction from the bottom of the cooking utensil through the layers of end cap 30 to generate an electrical control effect or signal which is then transmitted by conductor wires 40 through tubular arm 22 to the surface unit temperature controls (not shown). In the embodiment of FIG. 2, the heat responsive means is a thermocouple 34 comprising the ends of conventional wires 40 welded at points 34*a*, 34*b* to the disc 33. With the arrangement as shown, the end cap 30 is permitted to tilt sufficiently to allow automatic adjustment between the end cap and any warped bottom surface of the cooking utensil. The construction and operation of the surface unit temperature controls to which the thermocouple wires are connected are considered to be well enough known as not to require discussion herein since it is outside the scope of the present invention.

Figure 4:
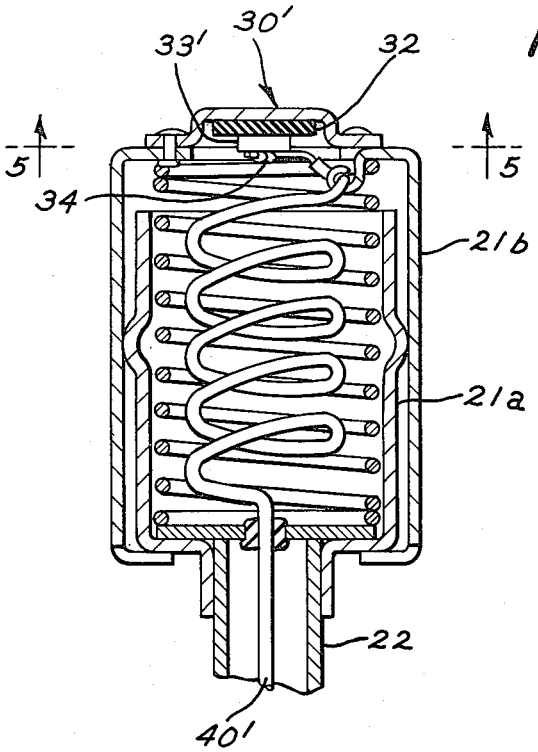
FIG. 4 is a side sectional view of an alternative form of heat sensing apparatus constructed in accordance with the present invention.
Figure 5:
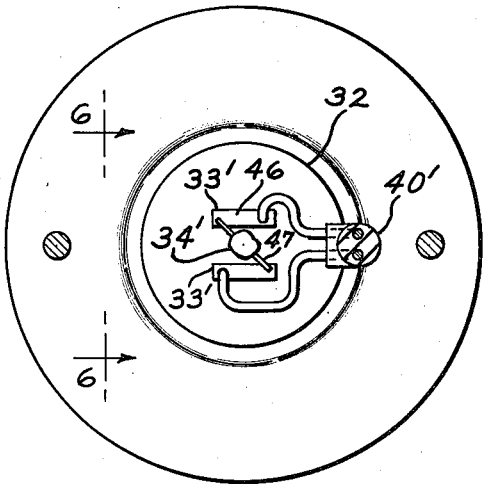
FIGS. 5 and 6 are bottom and side views respectively of the end cap embodied in the heat sensing apparatus of FIG. 4 illustrating further structural details thereof.
Figure 6:
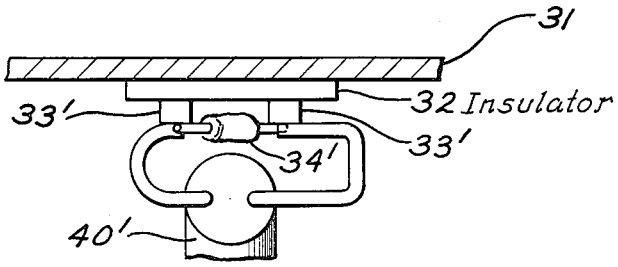

Referring now to FIGS. 4–6, there will be described an alternative form of heat sensing apparatus utilizing a thermistor as the particular heat responsive device. It most respects, the structure of the apparatus is the same as that previously described. Consequently, only the modifications will be considered, with primed reference numerals being used to indicate modified components. Specifically, end cap 30' includes as its third layer a pair of discrete bars 33' brazed to the underside of insulator pad 32. Bars 33' are preferably of the same material as suggested for the disc 33 of FIG. 2. The end leads 46, 47 of a thermistor heat responsive device 34' are welded to the bars 33' as are also the lead wires 40' extending out through tubular arm 22 to the automatic temperature control. Preferably, the end leads of thermistor 34' are slightly oversized, on the order of 0.025 inch, to enhance heat conduction from bars 33' to the thermistor 34'.

The inner tubular housing element 21*a'* of FIG. 4 is provided with a circumferential bulge around the center of the element, the apex of which bears against the inner surface of outer housing element 21*b*. The purpose of this is to hold outer element 21*b* centered around the inner element 21*a'*.

While, in accordance with the patent statutes, there have been described what at present are considered to be one or more useful embodiments of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. Heat sensing apparatus for an automatic surface unit control of an electric range comprising:

a housing having an upper end portion adapted for contact with the bottom of a cooking utensil when placed on a surface unit;

housing support means for holding the housing within the surface unit and for biasing it upwardly to assure contact of said upper end portion with the utensil bottom;

said housing upper end portion comprising a first utensil contact layer of low thermal mass, heat conductive material, a second layer of electrically insulative, heat conductive material secured to the underside of the first contact layer, and a third layer of electrically conductive, heat conductive material secured to the underside of the second insulative layer;

and heat responsive means attached to said third layer for sensing utensil heat as transmitted through said upper end portion and for providing an electrical signal representative thereof to an automatic surface unit control.

2. The heat sensing apparatus of claim 1 in which said housing includes an inner housing element and an outer housing element loosely telescoped over said inner element, and in which said housing upper end portion comprises a separate end cap assembly attached to the outer housing element at the upper end thereof.

3. The heat sensing apparatus of claim 1 in which the thermal coefficient of expansion of the three layers of material in said upper end portion are substantially the same.

4. The heat sensing apparatus of claim 1 in which the utensil contact layer and third layer materials are a composition by weight of approximately 29% nickel, 17% cobalt, 0.2% manganese and the balance of iron.

5. The heat sensing apparatus of claim 1 in which the utensil contact layer and third layer materials are comprised of a copper nickel alloy.

6. The heat sensing apparatus of claim 1 in which the second electrically insulative layer is beryllium oxide.

7. The heat sensing apparatus of claim 1 in which the third layer comprises a solid disc brazed to the second layer and the heat responsive device is a thermocouple wire pair, the heat sensing end leads of which are welded to the disc.

8. The heat sensing apparatus of claim 1 in which the third layer comprises a pair of discrete bars brazed to the second layer, and the heat responsive device is a thermister, each end lead of which is welded to one of the bars, and in which lead wires are connected to the bars for providing the heat responsive electrical signal to the automatic surface unit control.

9. The heat sensing apparatus of claim 1 in which the housing includes an inner tubular element mounted on the support means, an outer tubular element telescoped over the inner element with restraining tabs extending laterally beneath the lower end of the inner element, said apparatus further including compression spring means mounted internally of the inner element for biasing the outer element upward, the diameter of the outer element being sufficiently larger than that of the inner element to provide for a universal tilting movement of the outer element to allow automatic adjustment of contact alignment between the upper end portion of the outer element and any warped bottom surface of said utensil.

* * * * *